US006800809B2

(12) United States Patent
Moe et al.

(10) Patent No.: US 6,800,809 B2
(45) **Date of Patent: *Oct. 5, 2004**

(54) COAXIAL CABLE AND METHOD OF MAKING SAME

(75) Inventors: Alan N. Moe, Hickory, NC (US); Bruce J. Carlson, Hickory, NC (US); Scott M. Adams, Catawba, NC (US); Ronald Vacarro, Hickory, NC (US)

(73) Assignee: CommScope Properties, LLC, Sparks, NV (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 412 days.

(21) Appl. No.: 09/485,656

(22) PCT Filed: Aug. 6, 1998

(86) PCT No.: PCT/US98/16398

§ 371 (c)(1),
(2), (4) Date: Feb. 14, 2000

(87) PCT Pub. No.: WO99/09562

PCT Pub. Date: Feb. 25, 1999

(65) Prior Publication Data

US 2002/0053446 A1 May 9, 2002

Related U.S. Application Data

(60) Substitute for application No. PCT/US98/16398 on Aug. 6, 1998, which is a continuation-in-part of application No. 08/911,538, filed on Aug. 11, 1997, now abandoned.

(51) Int. Cl.[7] ..... H01B 7/34
(52) U.S. Cl. ..... 174/102 R
(58) Field of Search ..... 174/106 R, 107, 174/36, 102 R, 110 F, 120 R, 126.4; 333/243, 12

(56) References Cited

U.S. PATENT DOCUMENTS

| | | | | |
|---|---|---|---|---|
| 3,193,712 A | | 7/1965 | Harris | |
| 3,309,455 A | | 3/1967 | Mildner | |
| 3,516,859 A | * | 6/1970 | Gerland et al. | 174/110 F |
| 3,717,719 A | | 2/1973 | Smith et al. | |
| 4,104,481 A | | 8/1978 | Wilkenloh et al. | |
| 4,399,322 A | * | 8/1983 | Hafner, Jr. | 174/101.5 |
| 4,472,595 A | | 9/1984 | Fox et al. | |
| 4,707,569 A | * | 11/1987 | Yoshimura et al. | 174/100 F X |
| 5,068,497 A | | 11/1991 | Krieger | |
| 5,111,002 A | * | 5/1992 | Hollander | 136/230 |
| 5,210,377 A | | 5/1993 | Kennedy et al. | |
| 5,235,299 A | | 8/1993 | Vaille et al. | |
| 5,266,744 A | | 11/1993 | Fitzmaurice | |
| 5,274,712 A | | 12/1993 | Lindsay et al. | |
| 5,371,823 A | * | 12/1994 | Barrett et al. | 174/70 R |
| 5,500,488 A | | 3/1996 | Buckel | |
| 5,515,603 A | * | 5/1996 | Ziemek et al. | 174/36 X |
| 5,521,331 A | | 5/1996 | Hillburn | |
| 5,527,993 A | * | 6/1996 | Shotey et al. | 174/67 |
| 5,959,245 A | * | 9/1999 | Moe et al. | 174/36 |

FOREIGN PATENT DOCUMENTS

| | | |
|---|---|---|
| CA | 448670 | 5/1948 |
| EP | 504776 A | 9/1992 |
| FR | 2487568 | 1/1982 |
| FR | 2637127 A | 3/1990 |
| WO | WO 97 45844 A | 12/1997 |

* cited by examiner

*Primary Examiner*—Chau N. Nguyen
(74) *Attorney, Agent, or Firm*—Alston & Bird LLP

(57) ABSTRACT

The present invention is a flexible low loss coaxial cable comprising a cylindrical plastic rod, an inner conductor surrounding the plastic rod, a dielectric layer surrounding the inner conductor, and a tubular metallic sheath closely surrounding the dielectric layer. The coaxial cable can further include a protective polymer jacket surrounding the sheath. The cylindrical plastic rod supports the inner conductor in bending and can be formed around a central structural member. The present invention also includes a method of making flexible coaxial cable.

18 Claims, 4 Drawing Sheets

COAXIAL CABLE AND METHOD OF MAKING SAME

This application is a national stage filing of PCT/US98/16398 filed Aug. 6, 1998, which is a continuation of U.S. patent application Ser. No. 08/911,538, filed Aug. 14, 1997, now abandoned.

FIELD OF THE INVENTION

The present invention relates to a coaxial cable, and more particularly to an improved low-loss coaxial cable having enhanced bending, handling and electrical properties.

BACKGROUND OF THE INVENTION

The coaxial cables commonly used today for transmission of RF signals, such as cable television signals and cellular telephone broadcast signals, for example, include a core containing an inner conductor, a metallic sheath surrounding the core and serving as an outer conductor, and in some instances a protective jacket which surrounds the metallic sheath. A dielectric surrounds the inner conductor and electrically insulates it from the surrounding metallic sheath. In many known coaxial cable constructions, an expanded foam dielectric surrounds the inner conductor and fills the space between the inner conductor and the surrounding metallic sheath.

The design of coaxial cables has traditionally been a balance between the electrical properties (e.g., high signal propagation, low attenuation) and the mechanical or bending properties of the cable. For example, in some coaxial cable constructions, air and plastic spacers are used between the inner conductor and the outer conductor to reduce attenuation and increase signal propagation of the cable. Nevertheless, the plastic spacers that are placed between the inner and outer conductors do not provide much support in bending for the outer conductor and thus the outer conductor is subject to buckling, flattening or collapsing of the cable during bending which can render the cable unusable. One alternative has been to use foam dielectrics between the inner and outer conductors as described above. However, although the bending properties are improved, the rate at which the signals are propagated is typically reduced.

For example, EP 504 776 describes a coaxial cable comprising a polytetrafluoroethylene (PTFE) rod that surrounds a copper wire further surrounded by a conductive copper tape that forms the inner conductor. The conductive copper tape is applied by wrapping a tape helically around the supporting rod, by vapor deposition in a vacuum, by cathode sputtering, or chemically. An intermediate dielectric formed of expanded PTFE surrounds the conductive copper tape and is further surrounded by an outer conductor and an outer insulator. The outside diameter of the cable is 3.58 mm based on the diameter of the outer conductor.

One recent advance in the coaxial cable industry for RF cables has been the construction of larger diameter cables. Large diameter cables generally possess a greater average power rating and reduced attenuation over smaller diameter cables. Unfortunately, however, because these cables have large diameters, they are typically not as flexible as their smaller diameter counterparts. As a result, there is a greater level of difficulty in installing these cables. For this reason, large diameter cables have been designed with corrugated sheaths for greater flexibility.

Another problem with the large diameter cables has been that the cost of the large diameter solid inner conductors generally used in these cables is rather expensive because of the large amount of conductive material used. In consideration of this problem, one alternative in the design of conventional large diameter cables has been the use of corrugated metal tubing as the inner conductor. The corrugated metal tubing reduces the expense of the inner conductor and along with the corrugated outer conductor improves the bending properties of the cable. Nevertheless, the metal tubing is subject to the same problems in bending as the outer metallic sheaths typically used in the cables. Specifically, the metal tubing has the tendency to buckle, flatten or collapse during bending of the cable thus rendering the cable unusable. Furthermore, although the coat of the corrugated inner conductive tubing is reduced over solid inner conductors these corrugated inner conductive tubes are still rather expensive. Additionally, the corrugated inner and outer conductors typically cause attenuation and reflection (return loss) of the RF signals and can produce problems during connectorization of the cable.

SUMMARY OF THE INVENTION

The present invention provides a coaxial cable having excellent electrical properties, particularly for the transmission of RF signals. In addition, the present invention provides a coaxial cable which has outstanding flexibility and bending properties even for large diameter cables and which avoids buckling, flattening or collapsing in bending. he coaxial cable of the invention is easily connectorized and has good water blocking properties to prevent the flow of water through the coaxial cable. Furthermore, the present invention provides a coaxial cable and a method of making same at low cost.

These and other features are achieved in accordance with the present invention by providing a flexible coaxial cable having a cable core comprising a cylindrical plastic rod, an inner conductor surrounding the plastic rod, and a foam polymer dielectric layer surrounding the inner conductor. A tubular metallic sheath closely surrounds the cable core to provide an outer conductor for the cable. Additionally, the cable can include a protective polymer jacket which surrounds the sheath and can be adhesively bonded thereto. The cylindrical plastic rod comprises a solid or foam plastic material which supports the inner conductor in bending and can be adhesively bonded to the inner conductor. The plastic rod can also be supported by a central structural member to facilitate formation of the plastic rod. The coaxial cables of the invention have been particularly useful for large diameter cables, i.e., having outer metallic sheath diameters of more than 1.0 inches (2.5 cm), but can also be used with smaller diameter cables.

The present invention also comprises a method of making coaxial cables. In the method embodiment of the invention, a cylindrical plastic rod is advanced along a predetermined path of travel and an inner conductor is directed onto the plastic rod and encircles the plastic rod. Preferably, the inner conductor is formed such that it loosely encircles the plastic rod and is then sunk onto the foam plastic rod. In addition, the inner conductor is typically adhesively bonded to the plastic rod. A foamable polymer composition is extruded onto the inner conductor to form a cable core. A tubular metallic sheath is then formed onto the cable core and encircles the cable core. A protective polymer jacket can also be formed surrounding the sheath and can be adhesively bonded to the sheath. The plastic rod is preferably formed by extruding a polymer composition onto a central structural member. The inner conductor can then be formed by advancing a metal strip and longitudinally welding abutting portions of the metal strip around the plastic rod to form an inner conductive tube or the metal strip can be overlapped around the plastic rod.

These and other features of the present invention will become more readily apparent to those skilled in the art upon consideration of the following detailed description which describes both the preferred and alternative embodiments of the invention.

DETAILED DESCRIPTION OF THE INVENTION

Figure 1:
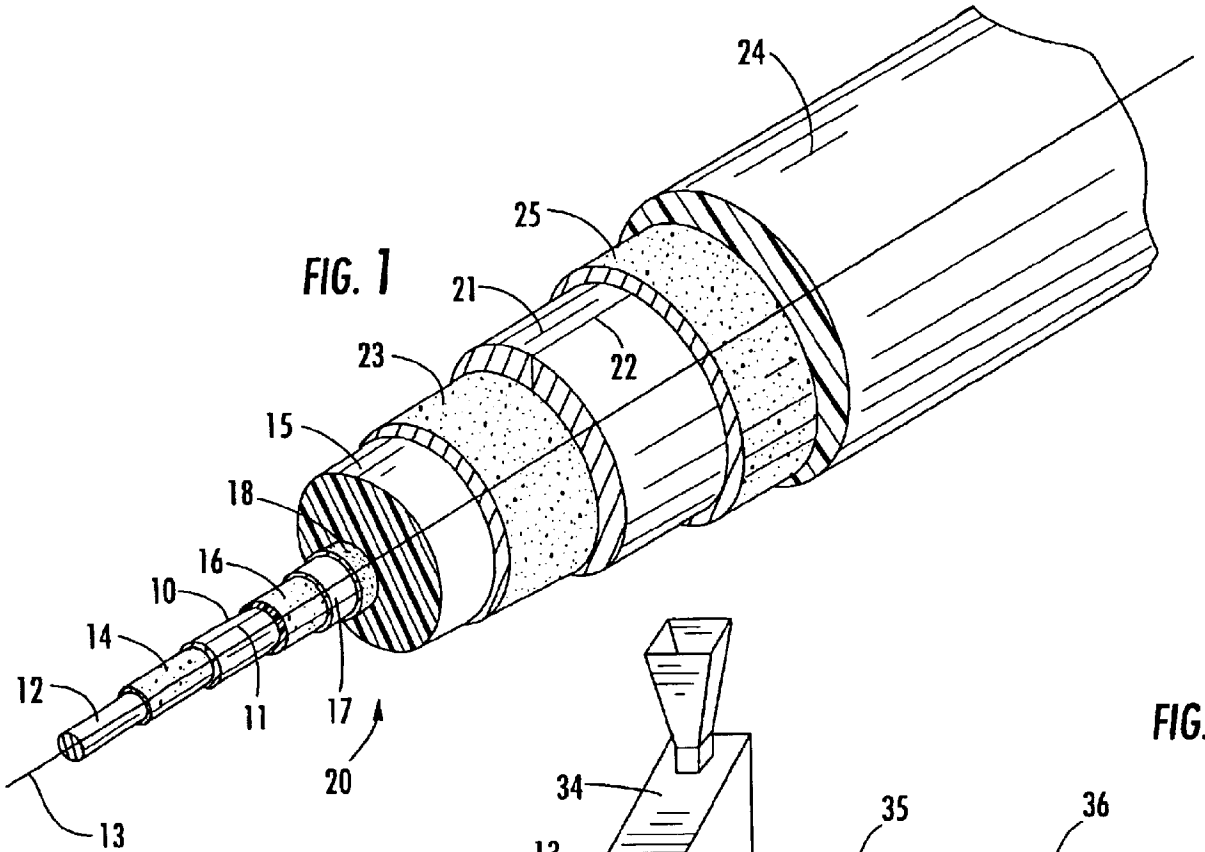
FIG. 1 is a perspective view showing a coaxial cable in accordance with the present invention in cross-section and with portions of the cable broken away for purposes of clarity of illustration.

FIG. 1 illustrates a coaxial cable produced in accordance with the present invention. The coaxial cable comprises an inner conductor 10. Preferably, the inner conductor 10 is formed of a suitable electrically conductive material such as copper. The inner conductor 10 preferably has a smooth-walled surface and is not corrugated. As illustrated in FIG. 1, the inner conductor 10 can include a longitudinal weld 11 which runs the length of the cable to form an inner conductive tube.

Preferably, the inner conductor 10 is made from a metallic strip S1 formed into a tubular configuration with the opposing side edges of the metallic strip butted together, and with the butted edges continuously joined by a continuous longitudinal weld, indicated at 11, preferably formed by a high frequency induction welding process. While production of the inner conductor 10 by high frequency induction welding has been illustrated as preferred, persons skilled in the art will recognize that other methods for producing the inner conductor could also be employed such as other welding methods (e.g. gas tungsten arc welding or plasma arc welding), overlapping the metallic strip S1 or by providing a previously formed, continuous metallic tube.

The inner conductor 10 is supported in bending by a cylindrical plastic rod 12 adjacent the inner surface of the inner conductor. The plastic rod 12 is preferably formed of a material such as polyethylene, polypropylene and polystyrene which will support the inner conductor 10 in bending and contribute to the overall compressive strength of the cable. Furthermore, the plastic material of the plastic rod 12 is preferably stable in humid or wet environments. The plastic rod 12 can be a solid plastic material or an expanded closed cell foam polymer material to prevent migration of water through the cable. Additionally, the plastic rod 12 can be supported by a central structural member 13 which facilitates the formation of the plastic rod. The central structural member 13 can include one or more materials which when combined form a high tensile strength support for the plastic rod 12. Suitable materials for the central structural member include reinforced plastic cords (e.g. Kevlar reinforced nylon cords and reinforced epoxy resin cords) and metal wires (e.g. copper and aluminum wire). Although the use of a central structural member 13 is preferred, the plastic rod 12 can be a continuous plastic rod having plastic material continuously running from a central longitudinal axis of the rod to the inner surface of the inner conductor 10 or a hollow plastic rod having a continuous portion adjacent the inner surface of the inner conductor and a void space adjacent a central longitudinal axis of the plastic rod. As shown in FIG. 1, the plastic rod 12 is typically adhesively bonded to the inner conductor 10 by an adhesive layer 14. Exemplary adhesive compositions for use in the adhesive layer 14 include random copolymers of ethylene and acrylic acid (EAA copolymers) and other copolymers which provide the desired adhesive properties.

The coaxial cable further comprises a dielectric layer 15 which surrounds the inner conductor 10. The dielectric layer 15 forms a continuous cylindrical wall of plastic dielectric material adjacent the outer surface of the inner conductor 10. The dielectric layer 15 is preferably a low lose dielectric formed of a suitable plastic such as polyethylene, polypropylene, and polystyrene. Preferably, in order to reduce the mass of the dielectric per unit length and hence reduce the dielectric constant, the dielectric material should be of an expanded cellular foam composition, and in particular, a closed cell foam composition is preferred because of its resistance to moisture transmission. Preferably, the cells of the dielectric 15 are uniform in size and less than 200 microns in diameter. One suitable foam dielectric is an expanded high density polyethylene polymer such as described in commonly owned U.S. Pat. No. 4,104,481, issued Aug. 1, 1978. Additionally, expanded blends of high and low density polyethylene are preferred for use as the foam dielectric. In order to reduce the dielectric constant of the dielectric layer 15, the foam dielectric has a density of less than about 0.28 g/cm$^3$ preferably, less than about 0.22 g/cm$^3$.

Figure 1A:
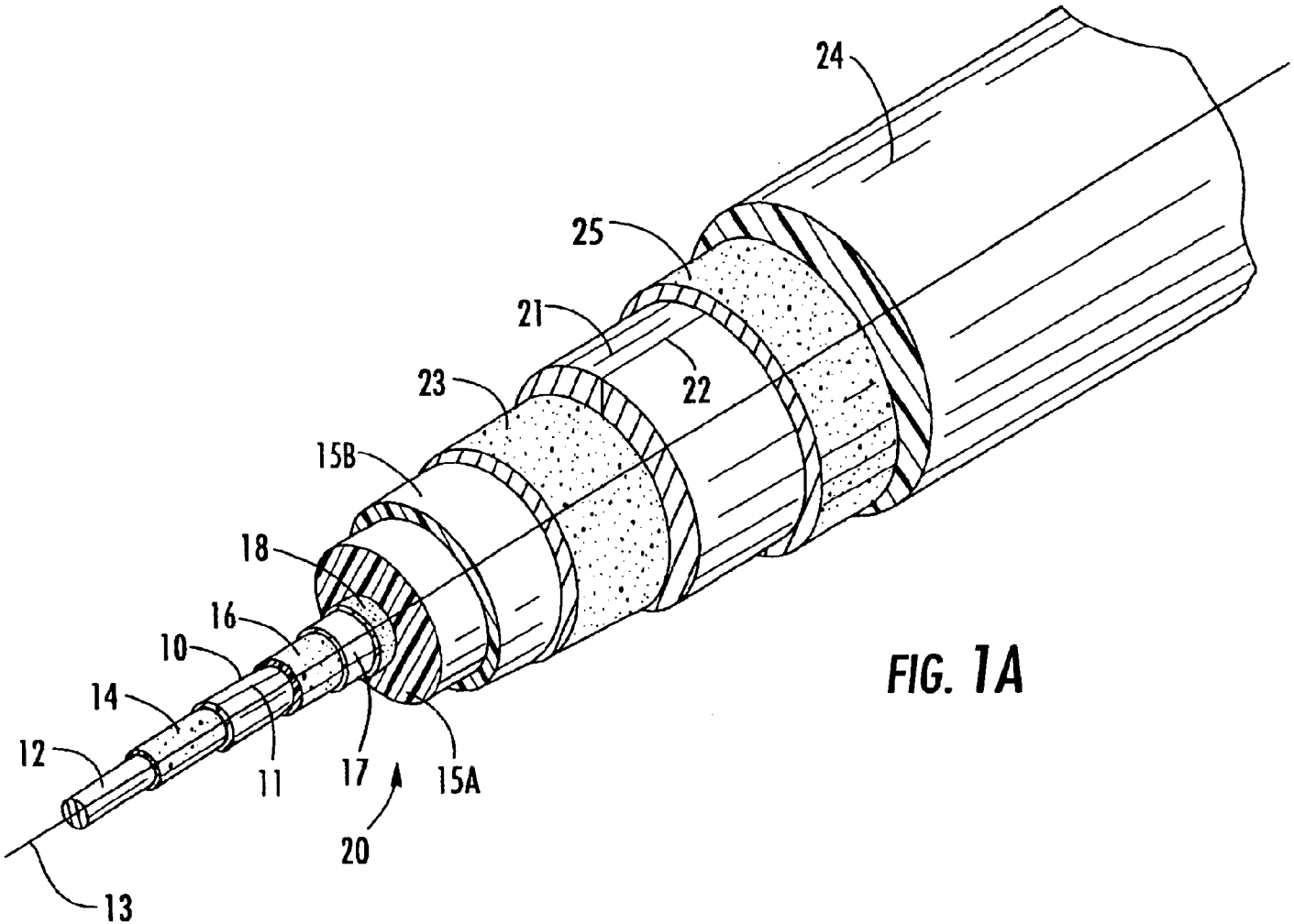
FIG. 1A is a cross-sectional view of an alternative embodiment of the invention wherein the dielectric layer comprises a low density foam dielectric layer surrounded by a solid dielectric layer.

Although the dielectric layer 15 of the invention generally consists of a uniform layer of foam material, the dielectric layer can have a gradient or graduated density such that the density of the dielectric increases radially from the inner conductor 10 to the outside surface of the dielectric layer, either in a continuous or a step-wise fashion. For example, as shown in FIG. 1A, a foam-solid laminate dielectric can be used wherein the dielectric layer 15 comprises a low density foam dielectric layer 15A surrounded by a solid dielectric layer 15B. These constructions can be used to enhance the compressive strength and bending properties of the cable and permit reduced densities as low as 0.10 g/cm$^3$ along the inner conductor 10. The lower density of the foam dielectric 15 along the inner conductor 10 enhances the velocity of RF signal propagation and reduces signal attenuation.

The dielectric layer 15 is typically bonded to the inner conductor 10 by a thin layer of adhesive 16 such as the EAA copolymer described above. Additionally, the cable can include a thin solid polymer layer 17 and another thin adhesive layer 18 which protect the outer surface of the inner conductor 10 as it is collected on reels as described below. As illustrated in FIG. 1, the inner conductor 10, the plastic rod 12, the foam dielectric layer 15, the optional solid plastic layer 17, and the corresponding adhesive layers form the cable core designated generally as 20.

Closely surrounding the cable core 20 is a tubular metallic outer sheath 21. The sheath 21 is generally characterized by being both mechanically and electrically continuous and typically includes a longitudinal weld 22. The mechanical and electrical continuity of the sheath 21 allows the sheath to effectively serve to mechanically and electrically seal the cable against outside influences as well as to seal the cable against leakage of RF radiation. Alternatively, the sheath can be perforated to allow controlled leakage of RF energy for certain specialized radiating cable applications. The tubular metallic sheath 21 of the invention preferably employs a thin walled copper sheath as the outer conductor. Moreover the tubular metallic sheath 21 has a wall thickness selected so as to maintain a T/D ratio (ratio of wall thickness to outer diameter) of less than 1.6 percent and preferably less than 1.0 percent or even 0.6 percent or lower. Preferably, the thickness of the metallic sheath 21 is less than 0.013 inch (0.33 mm) to provide the desired bending and electrical properties of the invention. In addition, the tubular metallic sheath 21 is preferably smooth-walled and not corrugated. The smooth-walled construction optimizes the geometry of the cable to reduce contact resistance and variability of the cable when connectorized and to eliminate signal leakage at the connector. Furthermore, the smooth-walled sheaths 21 can generally be produced at a lower cost than corrugated sheaths.

The inner surface of the tubular sheath 21 is preferably continuously bonded throughout its length and throughout its circumferential extent to the outer surface of the dielectric layer 15 by a thin layer of adhesive 23. Preferably, the adhesive layer 23 comprises a random copolymer of ethylene and acrylic acid (EAA) as described above. The adhesive layer 23 should be made as thin as possible so as to avoid adversely affecting the electrical characteristics of the cable. Desirably, the adhesive layer 23 should have a thickness of about 0.001 inch (0.025 mm) or less.

The outer surface of the sheath 21 is generally surrounded by a protective jacket 24. Suitable compositions for the outer protective jacket 24 include thermoplastic coating materials such as polyethylene, polyvinyl chloride, polyurethane and rubbers. Although the jacket 24 illustrated in FIG. 1 consists of only one layer of material, laminated multiple jacket layers may also be employed to improve toughness, strippability, burn resistance, the reduction of smoke generation, ultraviolet and weatherability resistance, protection against rodent gnaw through, strength resistance, chemical resistance and/or cut-through resistance. In the embodiment illustrated, the protective jacket 24 is bonded to the outer surface of the sheath 21 by an adhesive layer 25 to thereby increase the bending properties of the coaxial cable. Preferably, the adhesive layer 25 is a thin layer of adhesive, such as the EAA copolymer described above. Although an adhesive layer 25 is illustrated in FIG. 1, the protective jacket 24 can also be directly bonded to the outer surface of the sheath 21 to provide the desired bending properties of the invention.

Figure 2:
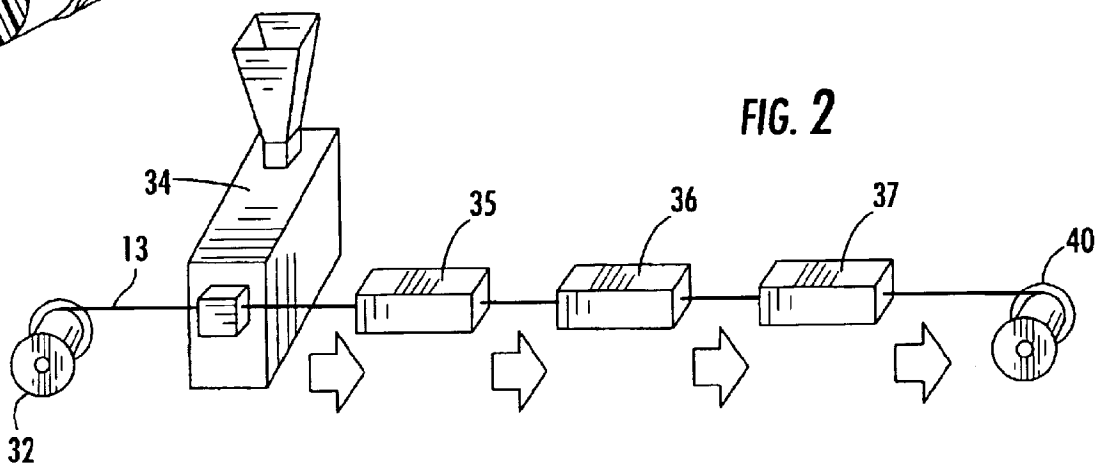
FIG. 2 is a schematic illustration of an apparatus for producing a plastic rod for use in the coaxial cable of the invention.

FIG. 2 illustrates a suitable arrangement of apparatus for producing the plastic rod 12 of the cable shown in FIG. 1. As illustrated, a central structural member 13 is advanced such as from reel 32. As stated above, the central structural member 13 can be a reinforced plastic cord or a metallic wire and provides structural support for the rod 12 and facilitates production of the rod. The central structural member 13 is advanced to an extruder apparatus 34 and crosshead die or similar device wherein a polymer composition is extruded around the central structural member 13 to form the plastic rod 12. As described above, the polymer composition can be a nonfoamable or foamable polymer composition thereby forming a solid or foam plastic rod 12. If the central structural member 13 is not used, the extruder apparatus 34 can be adjusted to continuously extrude the polymer melt into either a continuous cylinder or, through the use of a vacuum sizer, into a hollow cylinder. If a foamable composition is used, the polymer melt in the extruder apparatus 34 is injected with a blowing agent such as nitrogen to form the foamable polymer composition. In addition to or in place of the blowing agent, decomposing or reactive chemical agents can be added to form the foamable polymer composition. In extruder apparatus 34, the polymer melt is continuously pressurized to prevent the formation of gas bubbles in the polymer melt. Upon leaving the extruder 34, the reduction in pressure causes the foamable polymer composition to foam and expand to form either a continuous or hollow foam plastic rod 12. Alternatively, if a nonfoamable composition is used, the polymer material will harden and cool to form a solid plastic rod 12.

In addition to the polymer composition described above, an adhesive composition is preferably coextruded with the foamable polymer composition by the extruder 34 to form adhesive layer 14. The adhesive composition allows the plastic rod 12 to adhere to the inner conductor 10 thereby further increasing the support of the inner conductor in bending. Preferably, the adhesive composition is an ethylene acrylic acid (EAA) copolymer. Extruder apparatus 34 continuously extrudes the adhesive composition concentrically around the polymer melt. Although coextrusion of the adhesive composition with the polymer melt is preferred, other suitable methods such as spraying, immersion, or extrusion in a separate apparatus may also be used to apply the adhesive composition to the plastic rod 12. Alternatively, the adhesive composition can be provided on the inner surface of the inner conductor 10 thereby forming adhesive layer 14.

After leaving the extruder apparatus 34, the plastic rod 12 can be directed through an adhesive drying station 35 such as a heated tunnel or chamber. Upon leaving the drying station 35, the plastic rod 12 and is directed through a cooling station 36 such as a water trough. Water is then generally removed from the plastic rod 12 by an air wipe 37 or similar device. At this point, the adhesive coated plastic rod 12 can be collected on suitable containers, such as reels 40 prior to being further advanced through the portion of the manufacturing process illustrated in FIG. 3. Alternatively, the plastic rod 12 and can be continuously advanced through the remainder of the manufacturing process without being collected on reels 40.

Figure 3:
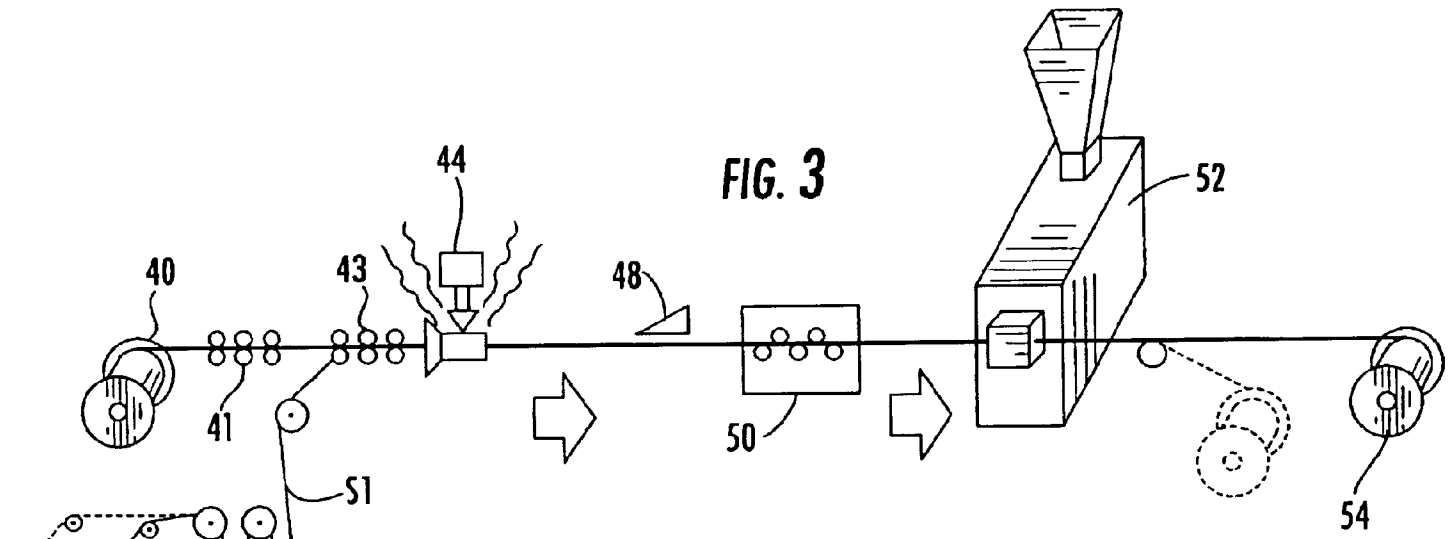
FIG. 3 is a schematic illustration of an apparatus for applying an inner conductor to a plastic rod for use in the coaxial cable of the invention.

As illustrated in FIG. 3, the adhesive coated plastic rod 12 is drawn from reels 40 and straightened by advancing the plastic rod through a series of straightening rolls 41. A narrow elongate strip S1 from a suitable supply source such as reel 42 is then directed around the advancing plastic rod 12 and bent into a generally cylindrical form by guide rolls 43 so as to loosely encircle the rod. Preferably, the strip S1 is formed of copper. Furthermore, as mentioned above, the surface of the strip S1 corresponding to the inner surface of the inner conductor 10 can be coated with an adhesive composition. Opposing longitudinal edges of the thus formed strip S1 are then moved into abutting relation and the strip is advanced through a welding apparatus 44 which forms a longitudinal weld 11 by joining the abutting edges of the strip S1. Preferably, high frequency induction welding is used to form the longitudinal weld 11 but other welding means such gas tungsten arc welding or plasma arc welding can be employed to join the opposing longitudinal edges of the strip S1, or the strip can be overlapped around the plastic rod 12.

The longitudinally welded strip S1 forms an inner conductor 10 loosely encircling the rod 12. In the preferred high frequency induction welding process described above, the longitudinal weld 11 of the inner conductor 10 can then be directed against a scarfing blade 48 which scarfs weld flash from the inner conductor formed during the high frequency induction welding process. If increased compressive strength is desired to prevent buckling, flattening or collapsing of the inner conductor 10 during the scarfing process, the inner conductor can be formed into an oval configuration prior to directing the inner conductor against the scarfing blade 48 and then reshaped into a circular configuration.

Once the longitudinal weld 11 is formed in the inner conductor 10, the simultaneously advancing plastic rod 12 and the inner conductor 10 are advanced through at least one sinking die 50 which sinks the inner conductor 10 onto the cable core and thereby causes compression of the plastic rod 12. A lubricant is preferably applied to the surface of the inner conductor as it advances through the sinking die 50.

Once the inner conductor 10 has been formed on the plastic rod 12, any lubricant on the outer surface of the inner conductor is removed to increase the ability of the inner conductor to bond to the dielectric layer 15. An adhesive layer 16 can then be formed onto the outer surface of the inner conductor 10 by advancing the plastic rod 12 and the surrounding inner conductor 10 through an extruder apparatus 52 where an adhesive composition such as an EAA copolymer is extruded concentrically onto the inner conductor to form the adhesive layer 16. In addition to the adhesive layer 16, a thin solid plastic layer 17 and optionally an adhesive composition forming adhesive layer 19 can be coextruded in the extruded apparatus 52 if desired to protect the inner conductor 10 when collected on reels 54. The plastic rod 12 and surrounding inner conductor 10 can then be quenched and dried, and collected on reels 54 before being further advanced through the portion of the process illustrated in FIG. 4 or can be directly advanced through the portion of the process illustrated in FIG. 4.

Figure 4:
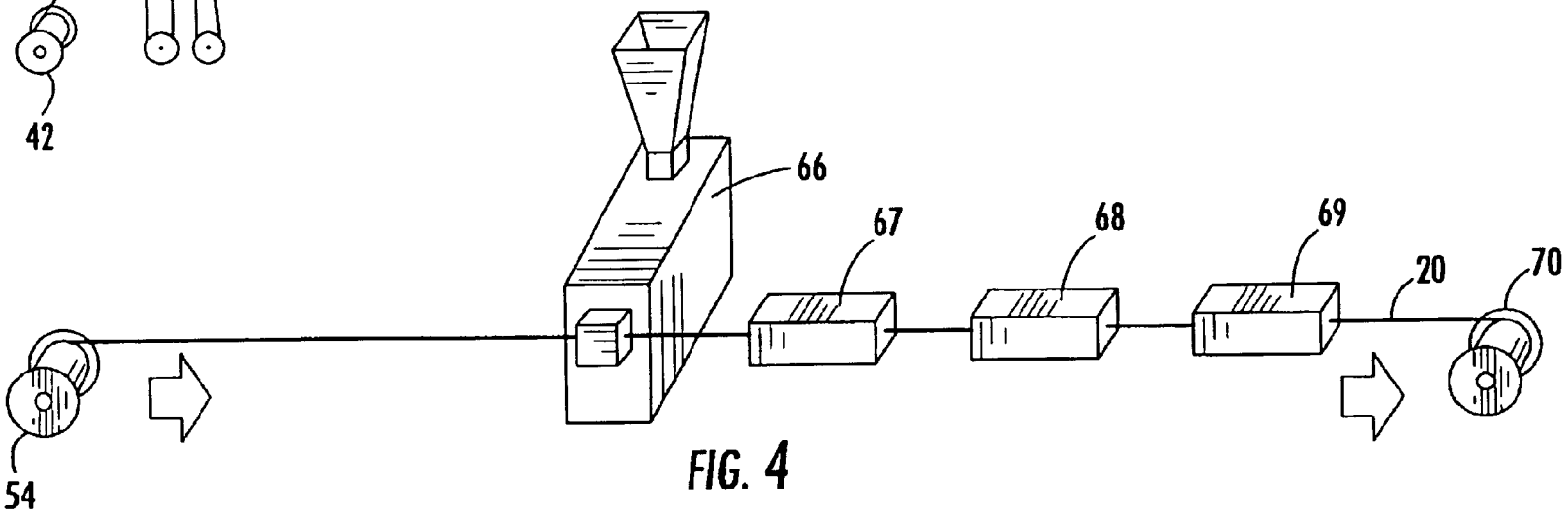
FIG. 4 is a schematic illustration of an apparatus for applying a dielectric layer and an adhesive composition on the surface of an inner conductor to form an adhesive coated cable core for the coaxial cable of the invention.

As illustrated in FIG. 4, the plastic rod 12 and surrounding inner conductor 10 can be directed from reel 54. The plastic rod 12 and surrounding inner conductor 10 are then advanced through an extruder apparatus 66 which applies a polymer composition used to form the dielectric layer 15. Preferably, a foamable polymer composition is used to form the dielectric layer 15. In the extruder apparatus 66, the components to be used for the foam dielectric layer 15 are combined to form a polymer melt. The polymer composition is preferably a foamable polymer composition therefore forming a foam dielectric layer 15. Preferably, high density polyethylene and low density polyethylene are combined with nucleating agents in the extruder apparatus 66 to form the polymer melt. These compounds once melted together are subsequently injected with a blowing agent such as nitrogen to form the foamable polymer composition. In addition to or in place of the blowing agent, decomposing or reactive chemical agents can be added to form the foamable polymer composition. In extruder apparatus 66, the polymer melt is continuously pressurized to prevent the formation of gas bubbles in the polymer melt. The extruder apparatus 66 continuously extrudes the polymer melt concentrically around the advancing inner conductor 10. Upon leaving the extruder 66, the reduction in pressure causes the foamable polymer composition to foam and expand to form a continuous cylindrical foam dielectric layer 15 surrounding the inner conductor 10.

In addition to the foamable polymer composition, an adhesive composition such as an EAA copolymer is preferably coextruded with the formable polymer composition to form adhesive layer 23. Extruder apparatus 66 continuously extrudes the adhesive composition concentrically around the polymer melt. Although coextrusion of the adhesive composition with the polymer melt is preferred, other suitable methods such as spraying, immersion, or extrusion in a separate apparatus spray also be used to apply the adhesive composition to the dielectric layer 15.

In order to produce low foam dielectric densities along the inner conductor 10 of the cable, the method described above can be altered to provide a gradient or graduated density dielectric. For example, for a multilayer dielectric having a low density inner foam layer and a high density foam or solid outer layer, the polymer compositions forming the layers of the dielectric can be coextruded together and can further be coextruded with the adhesive composition forming adhesive layer 23. Alternatively, the dielectric layers can be extruded separately using successive extruder apparatus. Other suitable methods can also be used. For example, the temperature of the inner conductor 10 may be elevated to increase the size and therefore reduce the density of the cells along the inner conductor to form a dielectric having a radially increasing density.

After leaving the extruder apparatus 66, the adhesive coated core 20 may be directed through an adhesive drying station 67 such as a heated tunnel or chamber. Upon leaving the drying station 67, the core is directed through a cooling station 68 such as a water trough. Water is then generally removed from the core 20 by an air wipe 69 or similar device. At this point, the adhesive coated core 20 may be collected on suitable containers, such as reels 70 prior to being further advanced through the remainder of the manufacturing process illustrated in FIG. 5. Alternatively, the adhesive coated core 20 can be continuously advanced through the remainder of the manufacturing process without being collected on reels 70.

Figure 5:
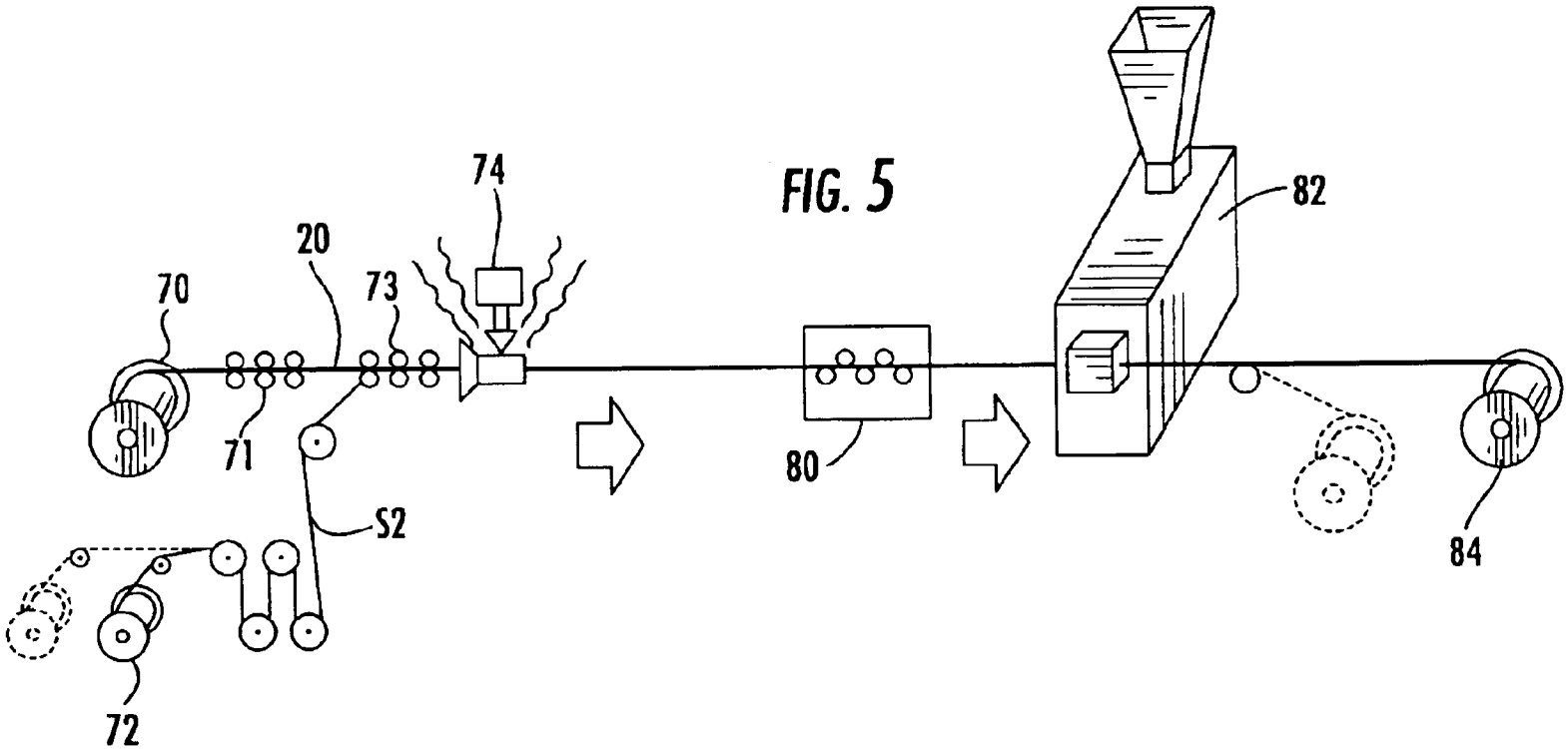
FIG. 5 is a schematic illustration of an apparatus for applying a sheath and optionally a jacket to an adhesive coated core to produce the coaxial cable of the invention.

As illustrated in FIG. 5, the adhesive coated core 20 can be drawn from reels 70 and further processed to form the coaxial cable. Typically, the adhesive coated core 20 is straightened by advancing the adhesive coated core through a series of straightening rolls 71. A narrow elongate strip S2 from a suitable supply source such as reel 72 is then directed around the advancing core and bent into a generally cylindrical form by guide rolls 73 so as to loosely encircle the core. Preferably, the strip 52 is formed of copper. Opposing longitudinal edges of the thus formed strip S2 are then moved into abutting relation and the strip is advanced through a welding apparatus 74 which forms a longitudinal weld 22 by joining the abutting edges of the strip S2. The longitudinally welded strip forms an electrically and mechanically continuous sheath 21 loosely surrounding the core 20. Preferably, a gas tungsten arc weld is formed to join the opposing longitudinal edges of the strip S2 but other welding methods such as plasma arc welding or high frequency induction welding (coupled with scarfing of weld flash) can also be used to form the longitudinal weld 22 in the sheath 21.

Once the longitudinal weld 22 is formed in the sheath 21, the simultaneously advancing core 20 and the sheath are advanced through at least one sinking die 80 which sinks the sheath onto the cable core and thereby causes compression of the dielectric layer 15. A lubricant is preferably applied to the surface of the sheath 21 as it advances through the sinking die 80. Once the sheath has been formed on the core 20, any lubricant on the outer surface of the sheath is removed to increase the ability of the sheath to bond to the protective jacket 24. An adhesive layer 25 and the protective jacket 24 are then formed onto the outer surface of the sheath 21. In the present invention, the outer protective jacket 24 is provided by advancing the core 20 and surrounding sheath 21 through an extruder apparatus 82 where a polymer composition is extruded concentrically in surrounding relation to the adhesive layer 25 to form the protective jacket 24. Preferably, a molten adhesive composition such as an EAA copolymer is coextruded concentrically in surrounding relation to the sheath 21 with the polymer composition which is in concentrically surrounding relation to the molten adhesive composition to form the adhesive layer 25 and protective jacket 24. Where multiple polymer layers are used to form the jacket 24, the polymer compositions forming the multiple layers may be coextruded together in surrounding relation and with the adhesive composition forming adhesive layer 25 to form the protective jacket. Additionally, a longitudinal tracer stripe of a polymer composition contrasting in color to the protective jacket 24 may be coextruded with the polymer composition forming the jacket for labeling purposes.

The heat of the polymer composition forming the protective jacket 24 serves to activate the adhesive layer 23 to form an adhesive bond between the inner surface of sheath 21 and the outer surface of the dielectric layer 15. Once the protective jacket 24 has been applied, the coaxial cable is subsequently quenched to cool and harden the materials in the coaxial cable. Once the coaxial cable has been quenched and dried, the thus produced cable may then be collected on suitable containers, such as reels 84, suitable for storage and shipment.

The coaxial cables of the present invention are beneficially designed to increase the bending properties of the coaxial cable. Specifically, the coaxial cables of the invention are designed to limit buckling, flattening or collapsing of the inner conductor 10 and the outer metallic sheath 21 during bending of the cable. During bending of the cable, one side of the cable is stretched and subject to tensile stress and the opposite side of the cable is compressed and subject to compressive stress. If the plastic rod 12 and core 20 are sufficiently stiff in radial compression and the local compressive yield loads of the inner conductor 10 and sheath 21 are sufficiently low, the tensioned sides of the inner conductor and sheath will elongate by yielding in the longitudinal direction to accommodate the bending of the cable. Accordingly, the compression sides of the inner conductor 10 and sheath 21 preferably shorten to allow bending of the cable. If the compression sides of the plastic rod and sheath do not shorten, the compressive stress caused by bending the cable can result in buckling of either the inner conductor or the sheath.

The polymer layers located on the compression side and tension sides of the inner conductor 10 and the outer metallic sheath 21 provide support for the inner conductor and sheath in bending. Furthermore, the adhesive layers 14, 16, 23 and 25 not only facilitate bonding between the polymer layers and the inner conductor 10 and sheath 21 but further support the inner conductor and sheath in bending. Therefore, the plastic rod 12, the foam dielectric layer 15, and the corresponding adhesive layers prevent buckling, flattening or collapsing of the inner conductor 10 and sheath 21 during bending.

In addition to increasing the bending properties of the inner conductor 10, the plastic rod 12 provides other benefits in the coaxial cables of the invention. Specifically, the plastic rod 12 allows a thin strip of metal to be used as the inner conductor 10 in the coaxial cables of the invention, and at a much lower cost than the corrugated inner conductive tubing used in conventional high diameter cables. Furthermore, the plastic rod 12 can prevent or greatly reduce the migration of water in the coaxial cable and specifically within the inner conductor 10. The adhesive layers and the foam dielectric layer 15 in the cable also provide the benefit of preventing the migration of water through the cable and generally provide the cable with increased bending properties. Moreover, because smooth-walled conductors can be used throughout the cables of the invention, the cables can be easily connectorized during installation, especially compared to similar cables having corrugated inner and outer conductors.

The coaxial cables of the present invention have enhanced bending characteristics over conventional coaxial cables. The coaxial cables of the invention are particularly useful in large diameter, low loss coaxial cables having a sheath diameter of 1.0 inches (2.5 cm) or more, In these cables the solid inner conductor used in conventional cables can be replaced with an inner conductor 10. As high frequency signals are carried an the outside surface of the inner conductor, this replacement does not decrease the propagative properties of the cable. Moreover, the bending properties of the cable are not decreased as the inner conductor 10 is supported in bending by the plastic rod 12. Therefore, the amount of conductive material is reduced and hence, so is the cost of the material used in the cable. Accordingly, the coaxial cables can be used or high frequency RF applications, e.g., 50 ohm applications. Although the coaxial cables of the invention have found utility in large diameter cable applications, the coaxial cables of the invention can also be used in smaller diameter cables, i.e., cables having a diameter of less than 1.0 inches (2.5 cm), to produce the same benefits described above.

As described above, the coaxial cables of the invention have excellent bending properties. Specifically, the coaxial cables of the invention have a core to sheath stiffness ratio of at least 5, and preferably of at least 10. In addition, the minimum bend radius in the coaxial cables of the invention is significantly less than 10 cable diameters, more on the order of about 7 cable diameters or lower. Furthermore, the tubular sheath wall thickness of the cable is such that the ratio of the wall thickness to its outer diameter (T/D ratio) is no greater than about 1.6 percent and preferably no greater than about 1.0 percent, and more preferably no greater than 0.6 percent. The reduced wall thickness of the sheath contributes to the bending properties of the coaxial cable and advantageously reduces the attenuation of RF signals in the coaxial cable.

It is understood that upon reading the above description of the present invention, one skilled in the art could make changes and variations therefrom. These changes and variations are included in the spirit and scope of the following appended claims.

That which is claimed:

1. A coaxial cable comprising:

a cylindrical plastic rod;

an electrically conductive tubular inner conductor surrounding said plastic rod, provided by forming a metal strip into a tubular configuration with the longitudinal side edges of the strip butted together and joined by a continuous longitudinal weld, and adhesively bonded to the plastic rod;

a continuous foam polymer dielectric layer closely surrounding the inner conductor; and a tubular metallic outer sheath closely surrounding the foam polymer dielectric layer.

2. The coaxial cable of claim 1 wherein said metallic sheath has a diameter of more than 1.0 inches (2.5 cm).

3. The coaxial cable of claim 1 wherein the ratio of the thickness of the metallic sheath to the outer diameter of the metallic sheath is no greater than 1.0 percent.

4. The coaxial cable of claim 1 further comprising a central structural member within said cylindrical plastic rod such that said central structural member supports said rod.

5. The coaxial cable of claim 4 wherein said central structural member comprises a reinforced plastic material or a metallic material.

6. The coaxial cable of claim 1 wherein said plastic rod is a closed cell foam plastic rod.

7. The coaxial cable of claim 1 further comprising a solid dielectric between said foam polymer dielectric layer and said sheath.

8. The coaxial cable of claim 1 wherein the density of said foam polymer dielectric layer increases radially from said inner conductor to said sheath.

9. The coaxial cable according to claim 1 wherein said inner conductor is copper, said foam polymer layer is adhesively bonded to said inner conductor, and said tubular metallic outer sheath is copper, said coaxial cable further comprising a protective polymer jacket surrounding said outer sheath and adhesively bonded thereto.

10. The coaxial cable according to claim 1 wherein said foam polymer dielectric layer is continuous from the inner conductor to the tubular metallic outer sheath.

11. The coaxial cable of claim 1 wherein said plastic rod is a hollow plastic rod.

12. The coaxial cable of claim 1 wherein said plastic rod is a continuous plastic rod.

13. The coaxial cable of claim 1 further comprising an adhesive layer between said inner conductor and said foam polymer dielectric layer.

14. The coaxial cable of claim 13, further comprising a solid polymer layer between said adhesive layer surrounding said inner conductor and said foam polymer dielectric layer.

15. The coaxial cable of claim 1 wherein said inner conductor is copper.

16. The coaxial cable of claim 1 wherein said foam polymer dielectric layer is adhesively bonded to said inner conductor.

17. The coaxial cable of claim 1 wherein said tubular metallic sheath is adhesively bonded to said foam polymer dielectric layer.

18. The coaxial cable of claim 1 further comprising a protective polymer jacket surrounding said outer sheath.

* * * * *

UNITED STATES PATENT AND TRADEMARK OFFICE

CERTIFICATE OF CORRECTION

PATENT NO. : 6,800,809 B2
DATED : October 5, 2004
INVENTOR(S) : Moe et al.

It is certified that error appears in the above-identified patent and that said Letters Patent is hereby corrected as shown below:

Title page,
Item [75], Inventors, "Ronald Vacarro" should read -- Ronald Vaccaro --.
Item [60], Related U.S. Application Data, should appear as follows:
-- This application is a national stage filing of PCT/US98/16398 on Aug. 6, 1998, which is a continuation of application No. 08/91,538, filed on Aug. 11, 1997, now abandoned. --.

Signed and Sealed this

Fourth Day of January, 2005

JON W. DUDAS
*Director of the United States Patent and Trademark Office*